United States Patent [19]

Dewey

[11] 4,397,412

[45] Aug. 9, 1983

[54] STANDUP SCREW GUN FOR LONG FASTENERS

[75] Inventor: George G. Dewey, Prospect Hts., Ill.

[73] Assignee: Illinois Tool Works Inc., Chicago, Ill.

[21] Appl. No.: 232,458

[22] Filed: Feb. 9, 1981

[51] Int. Cl.[3] ..... B25C 3/00

[52] U.S. Cl. ..... 227/119; 81/57.37

[58] Field of Search ..... 227/119, 120, 147, 112; 81/57.37, 451

[56] References Cited

U.S. PATENT DOCUMENTS

| | | | |
|---|---|---|---|
| 3,907,014 | 9/1975 | Manino | 144/32 |
| 3,960,191 | 6/1976 | Murray | 144/32 R |
| 3,973,605 | 8/1976 | DeCaro | 144/32 R |
| 4,236,555 | 12/1980 | Dewey | 221/179 |

*Primary Examiner*—Mark Rosenbaum
*Assistant Examiner*—Timothy V. Eley
*Attorney, Agent, or Firm*—David I. Roche; Thomas W. Buckman

[57] ABSTRACT

A standup screwgun having the capacity to drive twelve inch fasteners. The feed tube merges with the guide tube at a shallow angle enlarging the interface between the two tubes. Two triangular panel members extend along the interface with a first side of each lying generally on the inner cylindrical surface of the guide tube, a second side lying generally on the inner cylindrical surface of the feed tube and the third side extending angularly between the two tubes forming an inclined camming surface. The panels are spaced apart a distance capable of receiving the fastener shank but less than that of the fastener head. The leading end of the fastener is transferred gradually from the feed tube to the guide tube while the head is cammed laterally over a short length. This same or additional structure can prevent a misoriented fastener from reaching the guide tube and creating a jam.

10 Claims, 7 Drawing Figures

STANDUP SCREW GUN FOR LONG FASTENERS

BACKGROUND AND SUMMARY OF THE INVENTION

The present invention is directed to a standup screwgun. More particularly, the present invention is directed to standup screwguns capable of driving fasteners in excess of six inches in length.

The problem with driving such long fasteners is maintaining the overall tool length a managable length. One solution to this problem and a discussion of the parameters appear in U.S. Pat. No. 4,236,555, the relevant portions of which are hereby incorporated by reference. The solution disclosed therein was to collapse the screw feed attachment from both ends; that is, to collapse the nosepiece along with the fastener back toward the drive bit as well as collapsing the bit-containing end forwardly during screw feeding and driving.

This solution has been successful in maintaining a reasonable overall tool length for fasteners up to eight inches in length. The building industry in general and, more particularly, the built up roofing segment of the industry, is demanding ten and twelve inch fasteners and drive tools therefor to attach the thicker insulative boards to the roof decks. Double collapsibility alone, is insufficent to maintain reasonable tool lengths for these fastener lengths.

The present invention enables a reasonable length tool to be developed for feeding twelve inch fasteners. In order to accomplish this, it was necessary to identify a section of the tool capable of being shortened and providing the structure to make it possible. The shortenable section is the region where the fastener is transferred from the feed tube to the guide tube. By decreasing the angle between the two tubes, the length of the interface between them is increased. Two triangular panel members have one side generally coextensive with the inner surface of each tube and a third side forming a camming surface for laterally deflecting the head from the feed tube into the guide tube. This structure permits the leading end to transfer more gradually while the head is moved laterally very quickly reducing the length of this region to only a few inches.

A further feature of the present invention is the provision of means to prevent insertion of an inverted fastener into the guide tube. In field applications, a workman generally reaches into a pouch, grabs one of these long fasteners somewhere between its ends, extracts it and inserts it into the feed tube. If the workman is not paying close attention he may inadvertently insert the headed end first. Collapsing of the driver bit toward the pointed fastener end can result in a jammed or broken bit and possibly cause other damage to the tool.

The misfeed prevention feature of this invention is, then, important to overall tool life and operation. This feature comprises first and second offset feed tubes with a sloping interconnecting transition section. The height of the first tube and amount of incline of the transition section are such, for a particular minimum length and head diameter fastener, that entry into the second feed tube by an improperly oriented fastener is prevented. The misfeed prevention feature can be performed by the camming surface or by a specially configured funnel.

Other features, characteristics and advantages of the present invention will be more fully understood after a reading of the following specification when taken in conjunction with the accompanying drawings.

DETAILED DESCRIPTION OF THE PREFERRED EMBODIMENTS

Figure 1:
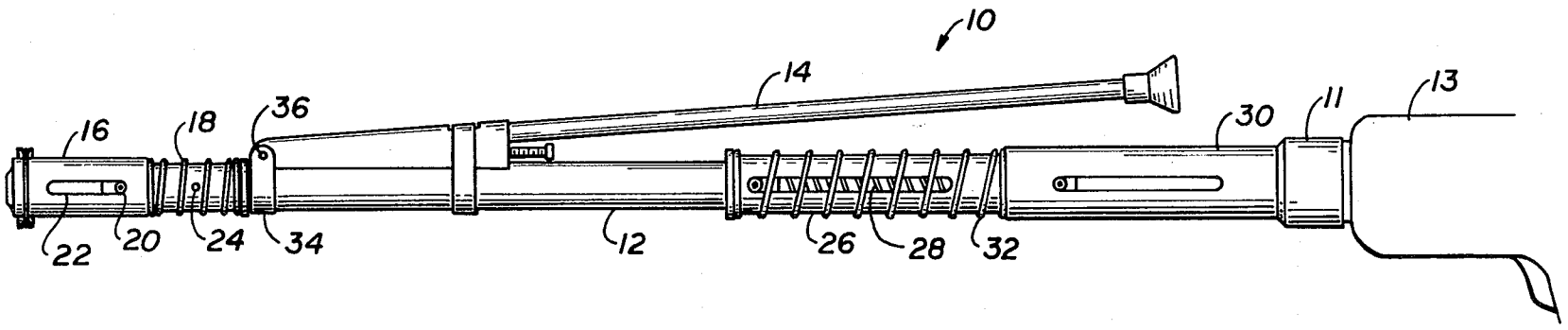
FIG. 1 is a side view of the attachment tool of the present invention.

The standup screwgun of the present invention is shown generally at 10. A guide tube 12 has an attachment ring 11 at one end for attachment to power tool 13. Feed tube 14 converges toward and intersects guide tube 12. The angle between guide tube 12 and feed tube 14 is relatively small such that there is a long interface between the tubes. Guide tube 12 has an axially extendable and retractable nosepiece 16 attached thereto and which is biased to its extended position by spring 18. Set screw 20 retains nosepiece 16 on guide tube 16 riding in slot 22 to permit the retractive motion. Set screw 20 may be moved to an alternate position 24 to collapse and retain the nosepiece against the bias of spring 18 in order to reduce the stroke length for shorter fasteners.

It should be noted that screwgun 10 is designed particularly for roofing applications to enable fastener driving without the need for stooping and bending. Tool 10, therefore, is intended for use in a vertically extending position and feed tube 14 will function effectively by gravity, making the use of positive feed mechanisms unnecessary.

A first telescoping section 26 collapses over guide tube 12, being biased to its extended position by spring 28. A second telescoping member 30 collapses over member 26 being biased to its extended position by spring 32. This multiple collapsibility can save two to three inches in tool length. Collapsibility of the nosepiece 16 can result in a length savings of an additional two to three inches. When designing a tool to accomodate up to twelve inch fastener lengths, even a few inches savings can be significant.

While every precaution has been taken in designing this tool, to avoid jams, some jams will inevitably occur, either as a result of a workman attempting to deposit more than one fastener in the feed tube at a time or attempting to feed a bent fastener, or the like. In any event, in anticipation of this potential problem, feed tube 14 is mounted on guide tube 12 by means of pivotal hinge 34. Clip 36 secures the tubes against undesired pivotal displacement. However, by releasing clip 36, tube 14 may be pivoted with respect to tube 12 providing access to the inside of each tube along the entire length of their interface in order to dislodge any possible jam.

Depending on the whereabouts of the jammed fastener, pivotal movement may be inappropriate. For example, if a second fastener has been inserted into the feed tube 14 prior to driving the first fastener from guide tube 12, that fastener will be partially occupying both tubes 12 and 14. Pivotal movement could not occur without ruining the second fastener, which, due to its length, is costly. For this reason, pivot pin 36 may readily be removed from hinge 34 so that tube 14 may be axially and laterally translated with respect to tube 12 to facilitate clearing of this type of jam. In general, however, it is believed jams will most frequently occur when feeding of an already bent fastener is attempted. For this type of jam, the pivotal movement of feed tube 14 relative to guide tube 12 provides quick access to the interface area for clearing. Pivot pin 36 may be flaired on one end and retained by a c-clip or cotter pin (not shown) on the other to permit easy removal. Locator pin 35 (FIG. 2) is provided on feed tube 14 and a recess in guide tube 12 to facilitate proper locating on reassembly.

Figure 2:
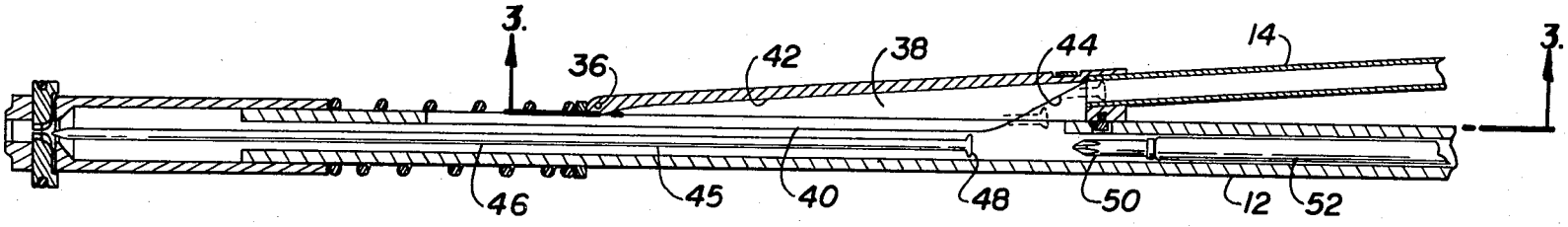
FIG. 2 is a side view in section of a portion of the tool depicted in FIG. 1.
Figure 3:
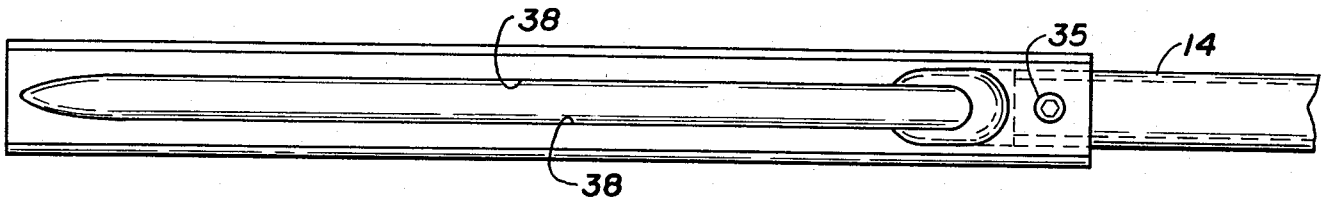
FIG. 3 is a lateral cross section as seen along line 3—3 in FIG. 2 on a larger scale.

Turning now to FIGS. 2 and 3, extending along the interface between guide tube 12 and feed tube 14 are two triangular panel members 38. Each triangular panel has a first side 40 lying generally on the inner cylindrical surface of tube 12 and a second side 42 lying generally on the inner cylindrical surface of tube 14. The third side 44 of each triangular panel 38 extends angularly between feed tube 14 and guide tube 12 defining an inclined camming surface.

The tool is designed to have a dimension between triangular panel members 38 which is greater than the largest diameter of shank 46 but less than the diameter of the smallest head 48 for fasteners 45 to be driven by the tool. Accordingly, the increased length of the interface permits the leading end of the fastener to be gradually transferred from feed tube 14 to guide tube 12 without creating a longer tool. The head is moved laterally over a short distance due to engagement with the camming surface formed by triangular panel sides 44. No longer is the full length of the interface "dead space" as in previous designs. Rather, as soon as the head 48 reaches a position adjacent sides 40, it is ready for engagement by drive bit 50. The head 48 will be engaged and guided by the edges 40 of the triangular panels as the fastener traverses the interface region.

Figure 4:
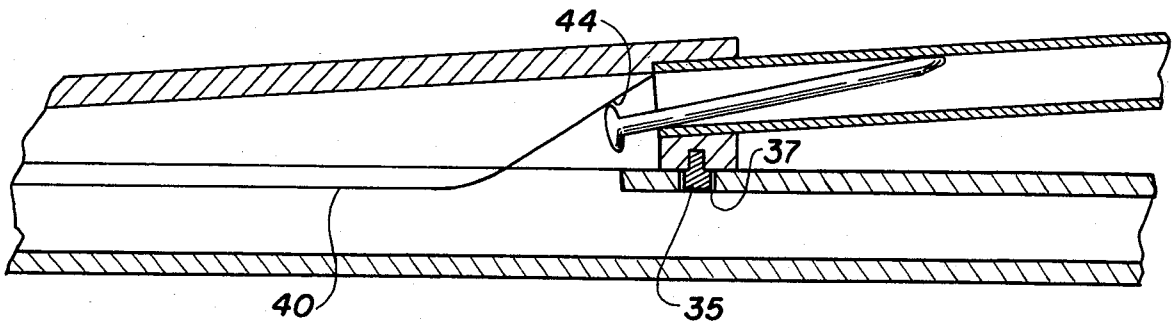
FIG. 4 is a sectional view showing a portion of the tool shown in FIG. 2 and depicting the results of inserting an improperly oriented fastener into the feed tube.

As shown in FIG. 4, these sides 44 provide a secondary function. A fastener 45 inserted head first in feed tube 14 is prevented entry to guide tube 12. This prevents drive bit 50 from engaging the tip of the fastener which will create a jam and possibly lead to breakage of the bit 50, driver rod 52, or gouging and other damage to the guide tube 12.

Figure 7:
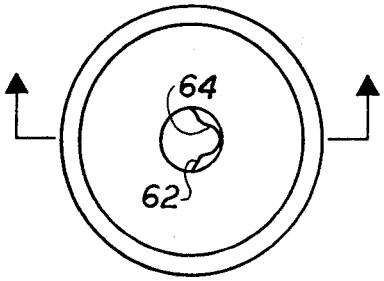
FIG. 7 is a top view of the feed tube shown in FIGS. 5 and 6.
Figure 5:
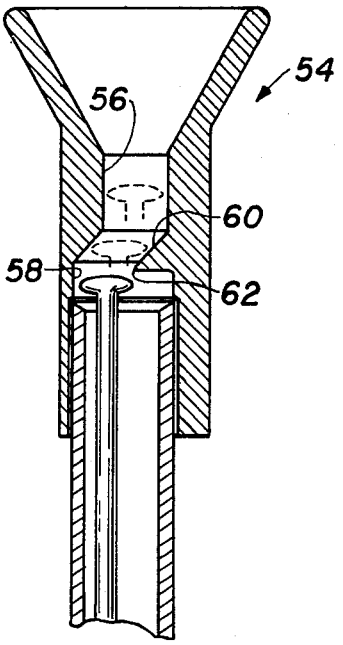
FIG. 5 is a sectional view of another form of misfeed preventing structure.
Figure 6:
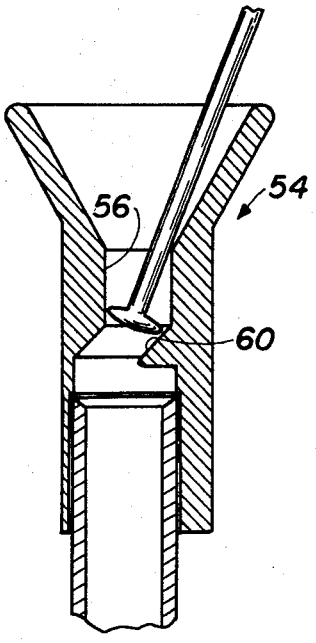
FIG. 6 is a sectional view similar to FIG. 5 showing the functioning of the feed tube with a misoriented fastener.

It would of course, be beneficial for the operator to know that the fastener had been improperly oriented before it reached side 44 where it is totally contained by tube 14. To this end, an alternate structure which is capable of performing this function is shown in FIGS. 5–7. The misfeed preventive feature is embodied in a specially designed funnel shown generally at 54. Funnel 54 has a first cylindrical feed section 56, a second cylindrical feed section 58 which is offset, and an inclined transition section 60. The length of feed section 56 and amount of inclination of transition section 60 are two key parameters in insuring that an improperly oriented fastener does not reach the second feed section 58. These parameters are selected for a particular minimum length of fastener 45 and minimum head dimension.

It has been found that one means of insuring that improperly oriented fasteners do not enter feed section 58 is to extend the transition section 60 so that its end wall 62 lies generally along the axis of first feed section 56. In order for properly oriented fasteners to be fed, this inclined transition section 60 must be slotted as at 64, said slot having a dimension greater than the shank diameter the tool is designed to handle yet smaller than the minimum head diameter.

Various changes, alternatives and modifications will be apparent to one of ordinary skill in the art following a reading of the foregoing specification. Accordingly, it is intended that all such changes, alternatives and modifications as come within the scope of the appended claims be considered part of the present invention.

I claim:

1. Feed tube means for feeding a fastener having a generally elongated shank and a head at one end thereof, said feed tube means comprising a first cylindrical feed section, a second cylindrical feed section longitudinally offset from said first section, and inclined transitional guiding and camming means therebetween for allowing a properly oriented fastener to reach said second feed section and for preventing an improperly oriented fastener from reaching said second section whereby said improperly oriented fastener is caught at least partially within said first section due to interference between the shank of said fastener and a wall of said first section and interference between said guiding and camming means and said head.

2. A device as described in claim 1 wherein said guiding and camming means includes a slotted center portion for receiving the shank of said fastener.

3. A device as described in claim 1 wherein said first and second sections are substantially parallel and a wall portion of said second section is generally in alignment with a center portion of said first section.

4. A device as described in claim 1 wherein said second section is a part of a longer tube for receiving and guiding the fastener during driving.

5. An attachment for a power tool enabling fasteners in excess of six inches in length and having a shank with a first predetermined maximum dimension and a head with a second larger predetermined maximum dimension to be driven from a standing position said attachment comprising a first cylindrical tube with an inner surface for receiving and guiding the fastener said inner surface having an internal diameter exceeding said second predetermined fastener dimension one end of said first tube having means for attachment to said power tool, a drive rod engageable with the power tool at one end and having a driver bit on the other, said drive rod axially displaceable within said first tube to engage and drive fasteners, a second cylindrical tube converging with said first tube at a predetermined angle and forming a gravitational feed tube, said second tube also having an inner surface with an internal diameter which exceeds said second predetermined fastener dimension said predetermined angle being small so as to form an elongated interface between said first and second tubes, first and second generally triangular panel members extending along the interface, a first side of each triangular panel lying generally on the inner surface of said first cylindrical tube, a second side of each triangular panel lying generally on the inner surface of said second cylindrical tube, a third side of each triangular panel extending angularly between said first and second cylindrical tubes forming an inclined camming surface, said first and second generally triangular panel members being spaced apart by a distance greater than said first predetermined maximum dimension of the fastener shank but less than said second predetermined maximum dimension of the fastener head such that a fastener inserted into the feed tube in the head trailing condition will have the shank pass between the generally triangular panel members and enter the guide tube, with the head engaging the inclined camming surfaces of the panels and being laterally deflected into the guide tube in alignment with said drive rod.

6. The attachment of claim 5 wherein the triangular panel members are integrally formed portions of a segment which interconnects said first and second cylindrical tubes.

7. The attachment of claim 6 wherein the segment is hingedly connected to said first cylindrical tube such that the two tube members may be separated along their interface.

8. The attachment of claim 7 wherein the hinge includes a removable pivot pin so that the second tube may be axially and laterally translated with respect to the first tube in addition to pivoting.

9. The attachment of claim 5 wherein the end opposite that which attaches to the power tool is equipped with an extendable and retractable nosepiece which is spring-biased to its extended position.

10. The attachment of claim 9 wherein the nosepiece is equipped with means to lock it in its retracted position against the spring-bias.

* * * * *